US005301522A

United States Patent [19]

Ikemizu et al.

[11] Patent Number: 5,301,522

[45] Date of Patent: Apr. 12, 1994

[54] ABNORMAL VIBRATION DETECTING DEVICE FOR WASHING MACHINE

[75] Inventors: Tokihiko Ikemizu, Kasugai; Katsuharu Matsuo, Aichi; Masahiro Imai, Seto, all of Japan

[73] Assignee: Kabushiki Kaisha Toshiba, Kawasaki, Japan

[21] Appl. No.: 95,356

[22] Filed: Jul. 20, 1993

Related U.S. Application Data

[63] Continuation of Ser. No. 949,436, Sep. 23, 1992, abandoned.

[30] Foreign Application Priority Data

Oct. 15, 1991 [JP] Japan ..... 3-266068

[51] Int. Cl.[5] ..... D06F 33/02

[52] U.S. Cl. ..... 68/12.06; 68/12.16

[58] Field of Search ..... 68/12.06, 12.16

[56] References Cited

U.S. PATENT DOCUMENTS

| | | | |
|---|---|---|---|
| 3,152,462 | 10/1964 | Elliott et al. | 68/12.06 |
| 4,411,664 | 10/1983 | Rickard et al. | 68/12.06 |
| 4,765,161 | 8/1988 | Williamson | 68/12.06 |
| 5,001,910 | 3/1991 | Harmelink et al. | 68/12.06 |

FOREIGN PATENT DOCUMENTS

| | | | |
|---|---|---|---|
| 0302319A1 | 2/1989 | European Pat. Off. | D06F 35/00 |
| 0349798A2 | 1/1990 | European Pat. Off. | D06F 37/20 |
| 64-27591 | 1/1989 | Japan | 68/12 |
| 2124662A | 2/1984 | United Kingdom | D06F 58/28 |

*Primary Examiner*—Frankie L. Stinson
*Attorney, Agent, or Firm*—Limbach & Limbach

[57] ABSTRACT

An abnormal vibration detecting device for detecting abnormal vibration of a rotational tub of a washing machine includes first and second abnormal vibration detectors. The first abnormal vibration detector includes a detecting lever rotatively moved where it collides with the rotational tub when it vibrates transversely, and a detection switch responsive to the rotative movement of the detecting lever. The second abnormal vibration detector includes a rotational speed detecting section detecting the rotational speed of a motor driving the rotational tub and a comparator section comparing a speed signal detected by the rotational speed detecting section with a reference speed signal determined based on the rise characteristic of rotation of the rotational tub appearing in the state that the rotational tub is in the condition of slight abnormal vibration.

3 Claims, 7 Drawing Sheets vac
Im
θm
vv
vi
vθ
vθa

ABNORMAL VIBRATION DETECTING DEVICE FOR WASHING MACHINE

This is a continuation of co-pending application Ser. No. 07/949,436 filed on Sept. 23, 1992 now abandoned.

BACKGROUND OF THE INVENTION

1 Field of the invention

This invention relates to an abnormal vibration detecting device for a washing machine for detecting abnormal vibration during rotation of a dehydration tub and more particularly to such an abnormal vibration detecting device of the type that the abnormal vibration of the dehydration tub is detected based on motor speed characteristics.

2. Description of the Prior Art

In conventional automatic washing machines, a rotational tub 2 serving both as a wash tub and a dehydration tub is driven by a dehydration motor 1 also serving as a wash motor, as shown in FIG. 7. The dehydration tub 2 is sometimes rotated in an unbalanced state during the dehydrating operation. In such a case, the dehydration tub 2 abnormally vibrates during its rotation. This abnormal vibration of the dehydration tub 2 is detected so that the dehydrating operation is interrupted. More specifically, upon occurrence of rotation of the dehydration tub 2 in the unbalanced state, a water-receiving tub 3 is abnormally vibrated as well as the dehydration tub 2. A detection lever 4 is provided for detecting the abnormal vibration of the water-receiving tub 3. The dehydrating operation is interrupted by a detection switch 5 responsive to the detection lever 4. The detection lever 4 is engaged with the water-receiving tub 3 only when the dehydration tub 3 is abnormally vibrated. The abnormal vibration of the dehydration tub 2 or the water-receiving tub 3 is thus detected mechanically.

The dehydration tub 2 is vibrated not only in the transverse direction but also in the vertical or longitudinal direction during the dehydrating operation. As a result, the dehydration tub 2 is abnormally vibrated in a mode that the transverse and longitudinal vibration components are composed. The above-described abnormal vibration detecting means comprising the detection lever 4 and the detection switch 5 are mainly suitable for detecting the transverse vibration component and not suitable for the detection of the longitudinal vibration component.

The rotational speed of the dehydration tub 2 is not increased desirably even when the vibration is mainly composed of the longitudinal vibration component, and accordingly, there is a possibility that the operation of the washing machine continues without smooth progress of the dehydration.

Means has been proposed for exclusively detecting the longitudinal movement of the dehydration tub 2. However, actual vertical movement of the dehydration tub 2 does not reflect the magnitude of the longitudinal vibration. Consequently, it is difficult to detect the abnormal longitudinal vibration by the method that the vibratory movement of the dehydration tub is mechanically converted to strokes, as is described above.

SUMMARY OF THE INVENTION

Therefore, an object of the present invention is to provide an abnormal vibration detecting device for a washing machine wherein the vibration due to rotation of the rotational tub in the unbalanced state can be reliably detected.

The present invention provides an abnormal vibration detecting device for a washing machine having an outer cabinet, a water-receiving tub mounted via elastic suspension means in the outer cabinet, a rotational tub mounted in the water-receiving tub for enclosing clothes to be washed, and an electric motor driving the rotational tub in a dehydration operation. The abnormal vibration detecting device comprises rotational speed detecting means for detecting a rotational speed of the rotational tub. The rotational speed detecting means generates a detection signal representative of the detected rotational speed of the rotational tub. Storage means is provided for storing data of predetermined rotational speed rise characteristics of the rotational tub as abnormal condition determining data. The predetermined rotational speed rise characteristics are in accordance with rise characteristics of the rotational speed of the rotational tub when the rotational tub is rotated in an unbalanced state and correspond to rotational speed rise characteristics of the rotational tub in a range of the rotational speed of the motor at a maximum torque thereof or above. Abnormal condition determining means is provided for comparing data of the rotational speed obtained from the detection signal generated by the rotational speed detecting means with the abnormal condition determining data stored in the storage means, and for determining whether or not the rotational tub is being rotated in the unbalanced state. Tub motion detecting switch means is provided including a detecting lever disposed to be moved when colliding with a part of the water-receiving tub swinging due to vibration caused by the unbalanced state of the rotational tub and a detection switch responding to the motion of the detecting lever.

In accordance with the above-described abnormal vibration detecting device, the abnormal condition determining data is in accordance with the rise characteristics of the rotational speed of the rotational tub when that its rotational speed does not smoothly rise at the starting because of its rotation in the unbalanced state. Accordingly, occurrence of the abnormal vibration is reliably predetermined from the comparison of the rotational speed data obtained by the rotational speed detecting means with the abnormal condition determining data.

The vibration of the rotational tub is converted to the mechanical strokes in the conventional device so that the vibration is detected. Differing from the conventional device, the abnormal condition detecting device of the present invention can effectively detect the vibration of the rotational tub even when the rotational tub is vibrated either in the longitudinal or transverse direction and even when the vibration amplitude is small.

The tub motion detecting switch may be mechanism comprising an actuator or detecting lever colliding with the rotational tub upon the swinging motion of the rotational tub or a light switch device wherein an optical path is connected and disconnected by the rotational tub with its swinging motion. In this case, the transverse component of the vibration is detected by the switch means for detecting the swinging motion of the rotational tub and the longitudinal component of the vibration and the transverse component are determined by the abnormal condition determining means.

The abnormal condition determining data stored in the storage means may correspond to the rotational speed rise characteristics of the rotational tub in a range of the rotational speed of the motor between the rotational speed of the motor at a maximum torque thereof or above and an ordinary rotational speed of the motor or below.

Furthermore, the abnormal vibration condition determining data may include data of a set elapsed period from the time of energization of the motor for the purpose of starting and data of a set rotational speed at the time when the set elapsed period has elapsed.

Other objects of the invention will become obvious upon understanding of the illustrative embodiment about to be described. Various advantages not referred to herein will occur to one skilled in the art upon employment of the invention in practice.

BRIEF DESCRIPTION OF THE DRAWINGS

An embodiment of the present invention will be described with reference to the accompanying drawings in which.

DESCRIPTION OF THE PREFERRED EMBODIMENT

Figure 1:
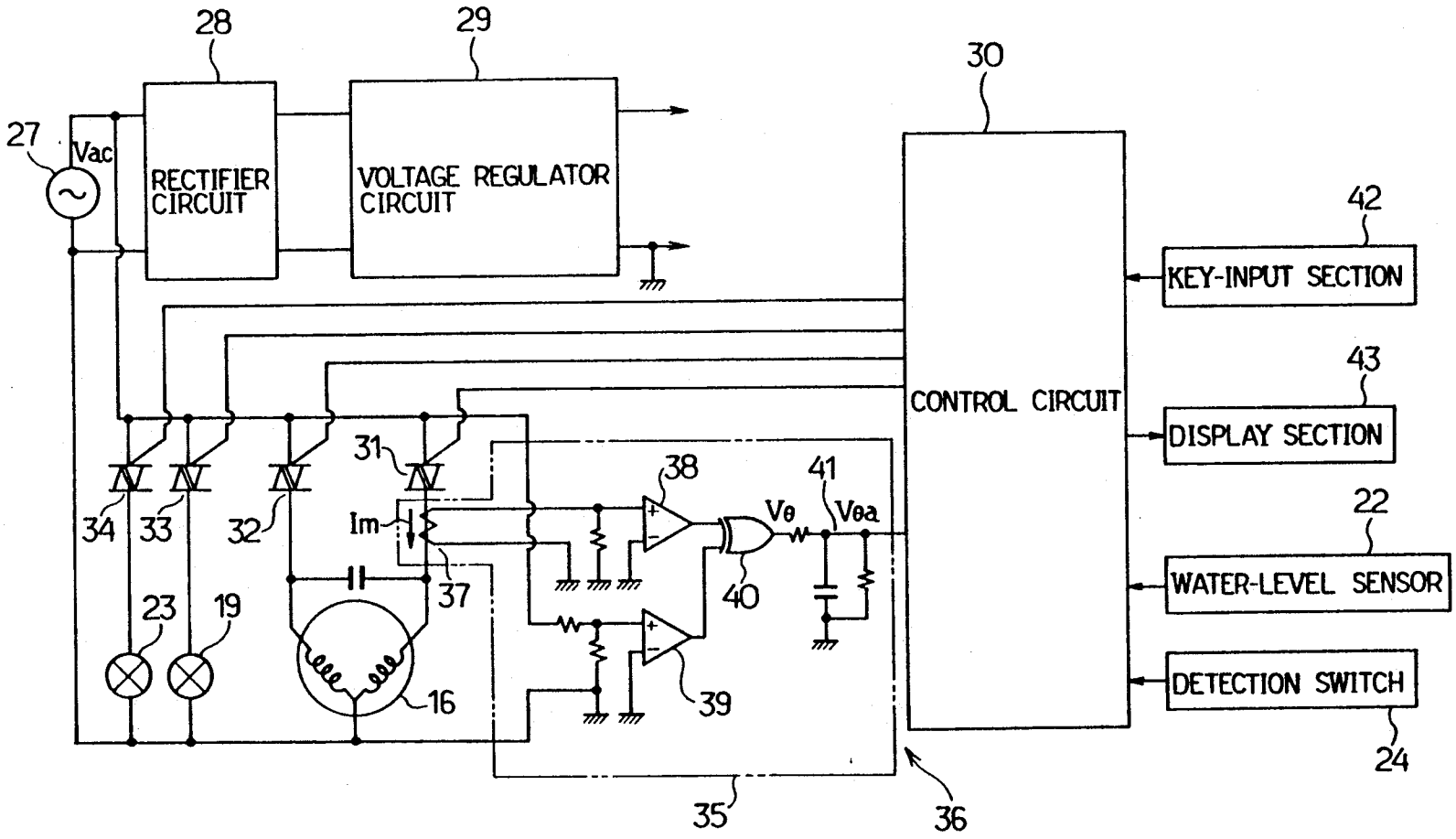
FIG. 1 is a circuit diagram showing an electrical arrangement of a washing machine incorporating an abnormal vibration detecting device in accordance with the present invention.

An embodiment of the present invention will be described with reference to FIGS. 1 through 6. FIG. 6 shows the construction of a known automatic washing machine in which the abnormal vibration detecting device in accordance with the present invention is incorporated. An outer cabinet 11 of the washing machine encloses a water-receiving tub 13 elastically suspended therein by an elastic suspension mechanism 12. A rotational tub 14 serving both for wash and for dehydration is rotatably mounted in the water-receiving tub 13. An agitator 15 is rotatably mounted on the inner bottom of the rotational tub 14. A washing machine motor 16 serving both for wash and for dehydration and a mechanism section 17 are mounted on the outer bottom of the water-receiving tub 13. A capacitive induction motor is employed as the washing machine motor 16. A drain hole 18 is formed in the bottom of the water-receiving tub 13 and a drain valve 19 is provided in the vicinity of the drain hole 18. An air trap 20 is formed adjacent to the drain hole 18. A water-level sensor 22 comprising a pressure sensor is connected to the air trap 20 through an air tube 21. The water-level sensor 22 is disposed in a rear space defined by a top cover 11*a* of the outer cabinet 11. A water-supply valve 23 and a detection switch 24 are also provided in the rear space. The detection switch 24 comprises a detecting lever 25 and constitutes tub-motion detecting switch means or first abnormal vibration detecting means 26. The detecting lever 25 is mounted to be inclined and to be rotatively moved in the transverse direction or in the direction of arrow A with its upper portion as a fulcrum. The detecting lever 25 usually hangs down as shown in FIG. 6 and collides with the water-receiving tub 13 to be rotatively moved in the direction of arrow A when the rotational tub 14 and that is, the water-receiving tub 13 are abnormally vibrated during the dehydration, as is shown by two-dot chain line in FIG. 6. The detection switch 24 is operated in response to the stroke of the rotative movement of the detecting lever 25. The mechanism section 17 transmits rotation of the washing machine motor 16 only to the agitator 15 in the wash step, thereby rotating the agitator 15. The mechanism section 15 transmits the rotation of the washing machine motor 16 to both the water-receiving tub 14 and the agitator 15 in the dehydration step so that both of them are rotated simultaneously at a high speed.

Referring now to FIG. 1, an alternating current from a commercial power supply 27 is rectified and smoothed by a rectifier circuit 28. Then, the voltage is converted by a voltage regulator circuit 29 to a low DC voltage of 5 volts, for example, as a power supply voltage for electronic circuitry. This low DC voltage is supplied to a control circuit 30 composed of a microcomputer and an analog-to-digital (A/D) converter.

The washing machine motor 16 is connected via triacs 31 and 32 between both terminals of the commercial power supply 27. The drain valve 19 and the water-supply valve 23 are also connected via respective triacs 33 and 34 between both terminals of the commercial power supply 27. The washing machine motor 16 is provided with a phase difference detecting circuit 35 detecting the phase difference between the voltage applied to the motor 16 and the current flowing through it. The phase difference detecting circuit 35 constitutes rotational speed detecting means 36 together with the microcomputer of the control circuit 30.

The phase difference detecting circuit 35 will now be described. A current transformer 37 is provided for detecting the current $I_m$ flowing into the washing machine motor 16. The current detected by the current transformer 37 is converted to a corresponding voltage, which voltage is applied to a non-inverting input terminal (+) of a comparator 38. An inverting input terminal (−) of the comparator 38 is grounded. The power supply voltage is divided by a resistance and the divided voltage is applied to a non-inverting input terminal (+) of a comparator 39. An inverting input terminal (−) of the comparator 39 is grounded. Output signals from the comparators 38, 39 are supplied to an input terminal of an exclusive OR circuit 40. An output signal from the exclusive OR circuit 40 is supplied to an integrating circuit 41. An output signal from the integrating circuit 41 is then supplied to the control circuit 30. Inputs to an key-input section 42 comprising an operation course selecting switch and a start switch are also supplied to the control circuit 30. A display section 43 is responsive to a control signal from the control circuit 30 to display various pieces of information.

Figure 5:
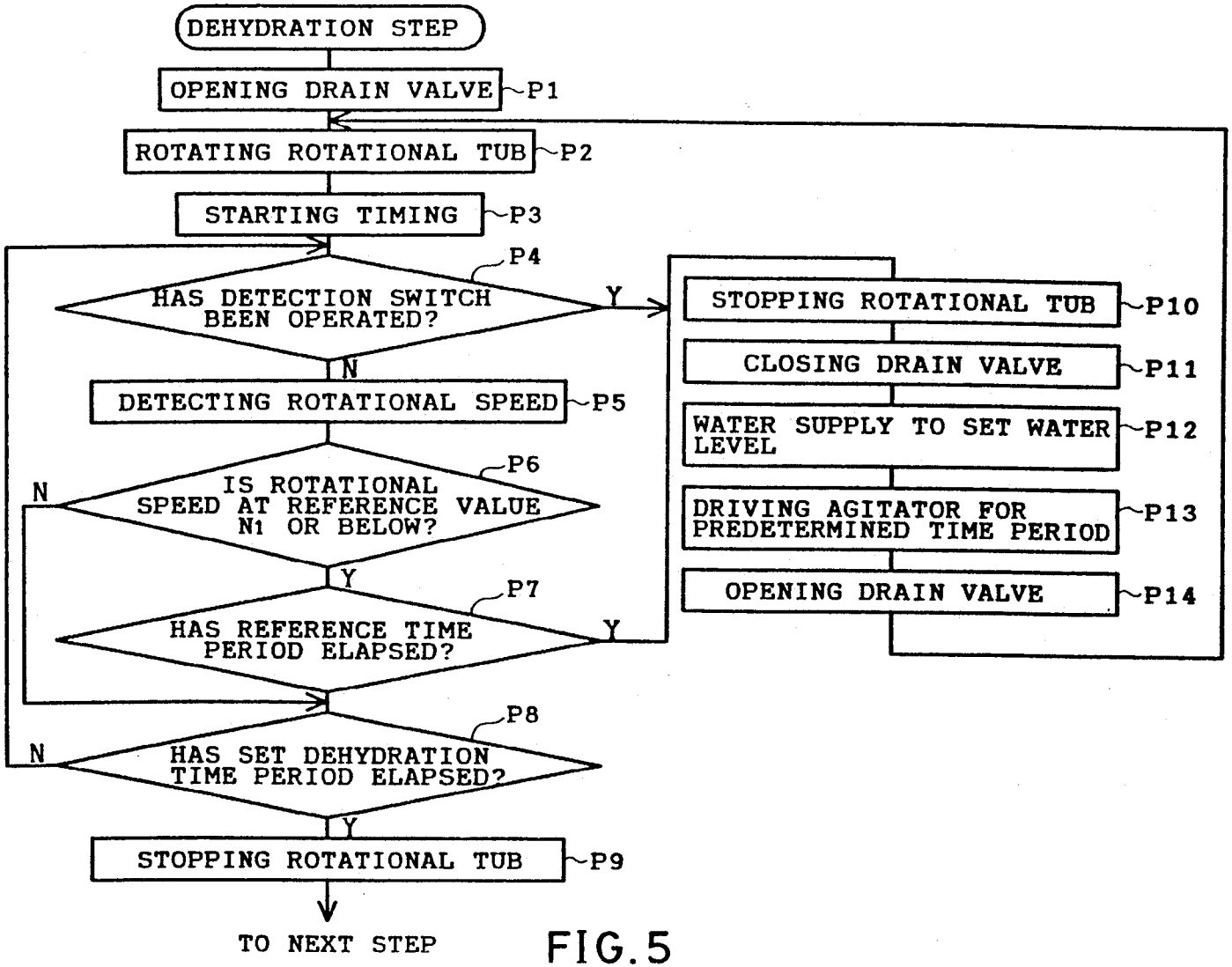
FIG. 5 is a flowchart explaining the control manner of a microcomputer.
Figure 6:
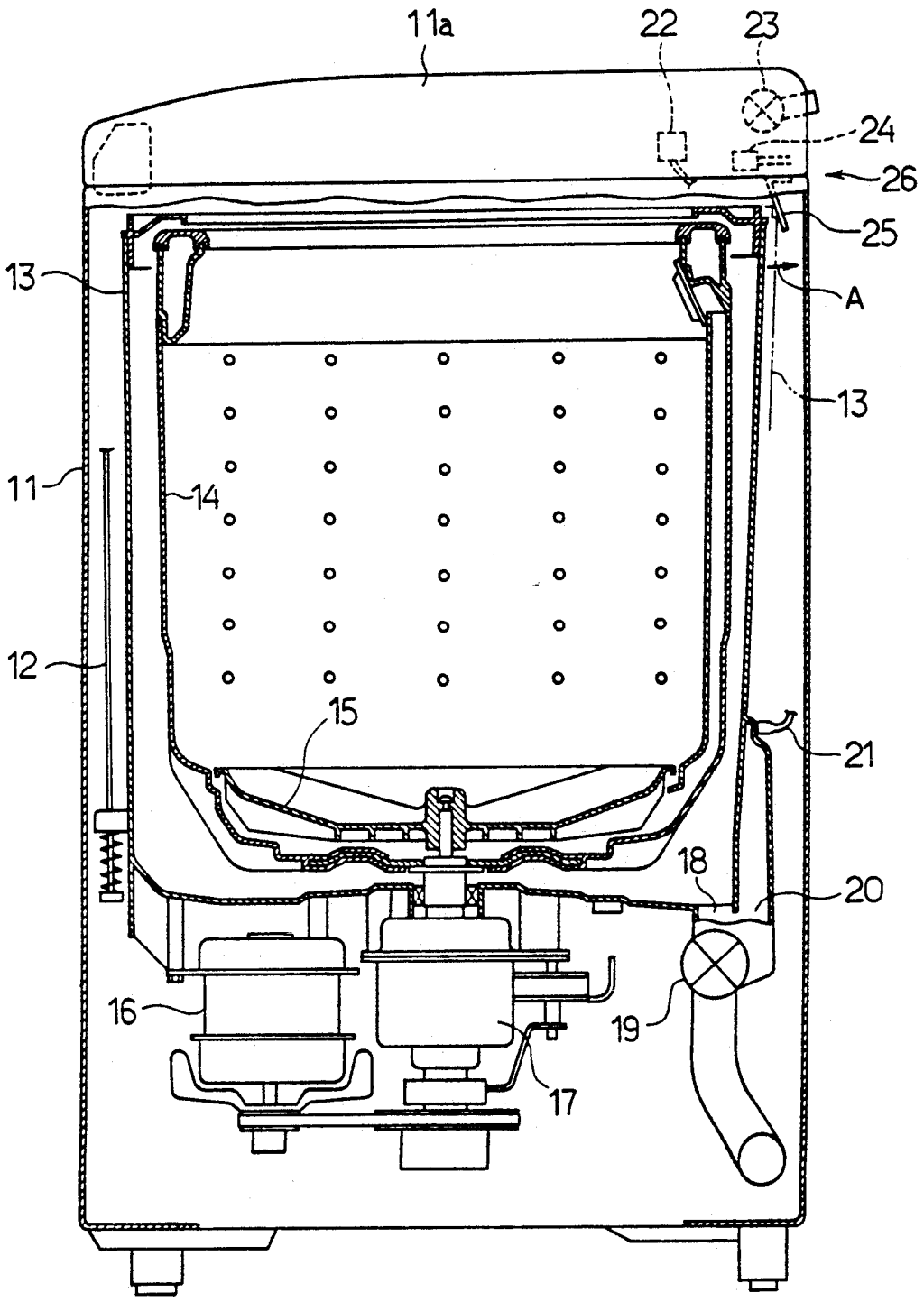
FIG. 6 is a longitudinally sectional view of the washing machine incorporating the abnormal vibration detecting device of the invention.
Figure 7:
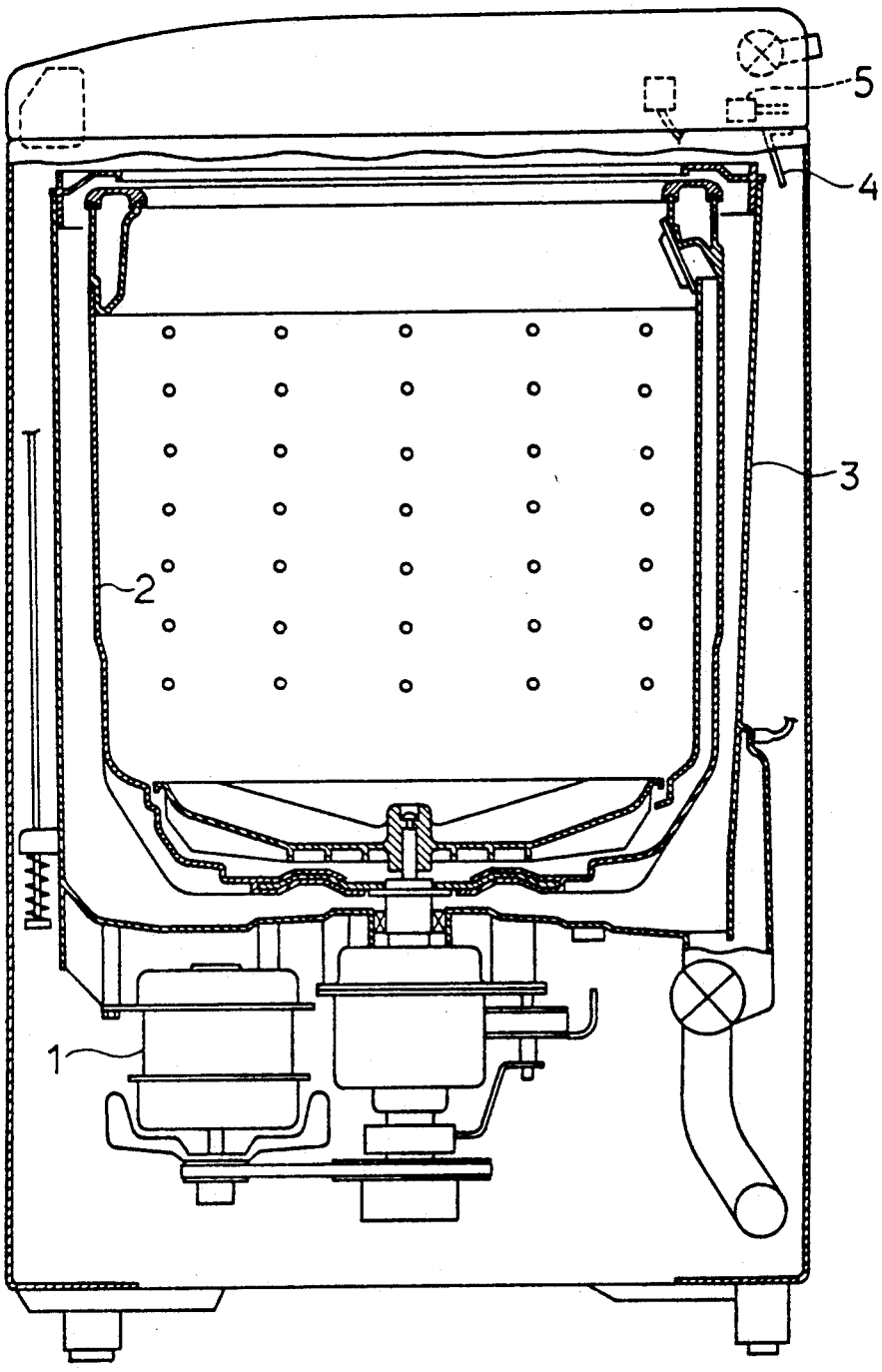
FIG.7 (PRIOR ART)
FIG. 7 is a longitudinally sectional view of a conventional washing machine showing the prior art.

The comparators 38, 39 of the phase difference circuit 35 generate pulses $V_v$ and $V_i$ based on the current $I_m$ and the power supply voltage $V_i$, respectively, as shown in FIG. 5. Then, the exclusive OR circuit 40 generates phase difference pulses $V_\theta$. An average voltage $V_{\theta a}$ of the phase difference pulses $V_\theta$ is generated by the integration circuit 41. This averaged phase difference detection voltage $V_{\theta a}$ is converted by the A/D converter in the control circuit 30 to a digital phase difference detection signal, which signal is supplied to the microcomputer.

Figure 2:
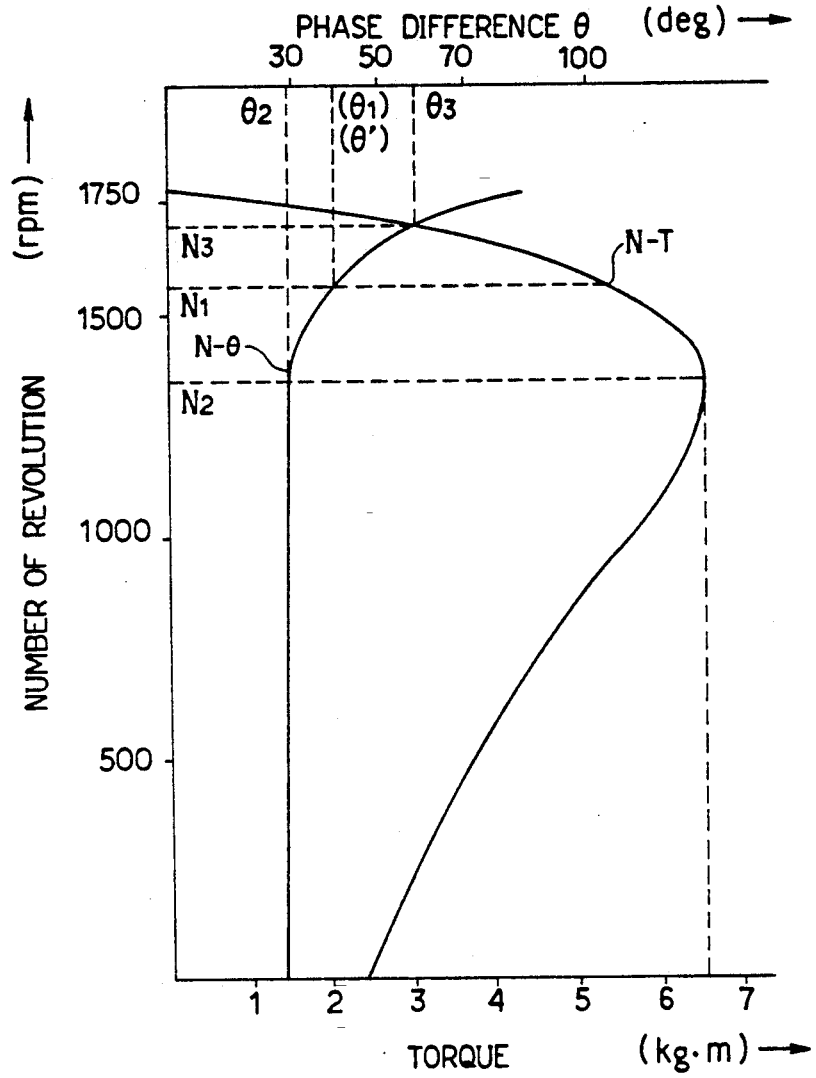
FIG. 2 is a graph showing characteristics of a general electric motor.
Figures 3A, 3B, 3C, 3D, 3E:
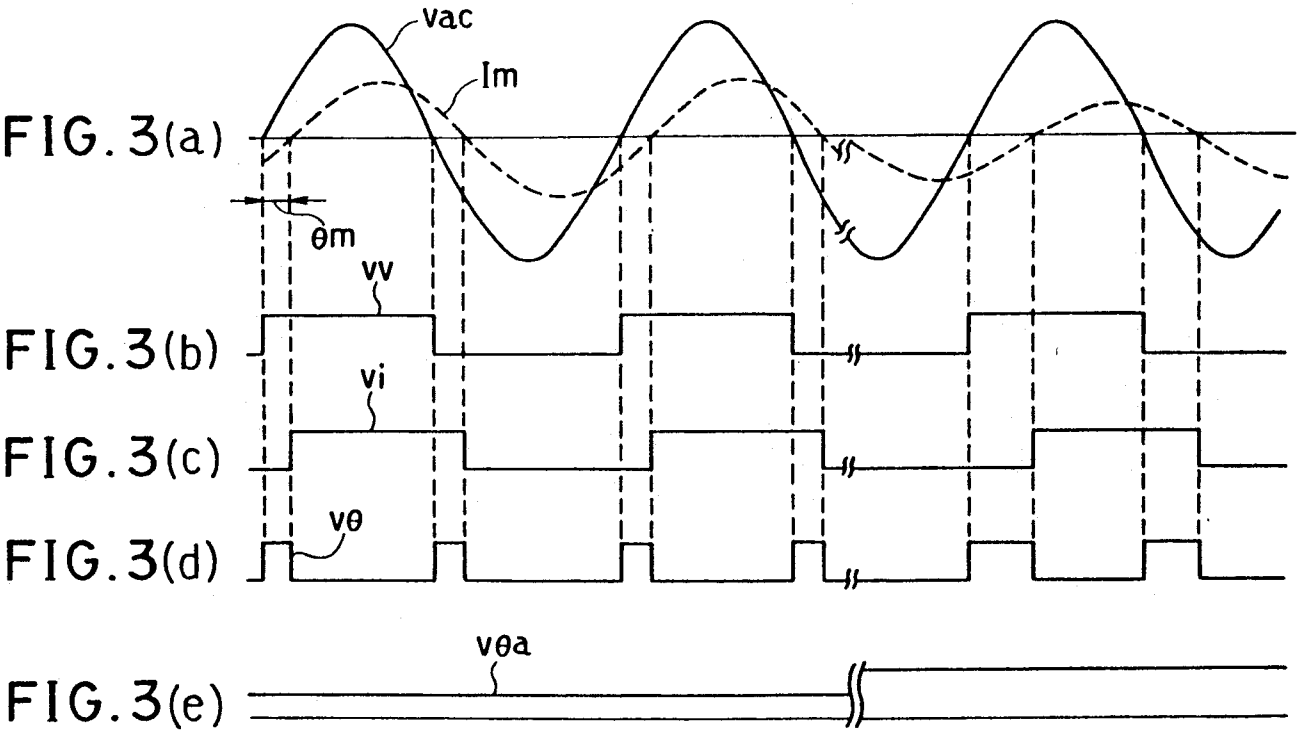
FIGS. 3(*a*)-3(*e*) are waveform charts for explaining the operation of a phase difference detecting circuit employed in the abnormal vibration detecting device.

Based on the digital phase difference detection signal, the microcomputer detects the rotational speed of the washing machine motor 16. FIG. 2 shows the relationship between the phase difference and the rotational speed in a general motor. A curve N-$\theta$ in FIG. 2 represents the relationship between the motor phase difference $\theta$ and its rotational speed. The phase difference $\theta$ shows little change while the motor speed is changed from "0" to "$N_2$" (maximum torque point). However, the phase difference $\theta$ is increased with the increase in the motor speed when the motor speed exceeds $N_2$. Accordingly, the rotational speed of the motor can be detected by detection of the phase difference $\theta$ in a section between the phase difference $\theta_2$ corresponding to the motor speed $N_2$ and the phase difference $\theta_3$ corresponding to the rotational speed $N_3$. The degree of increase of the phase difference $\theta$ is relatively mild in the section from the start to the speed $N_1$ but rendered relatively steep when the rotational speed $N_1$ is increased above $N_1$.

Figure 4:
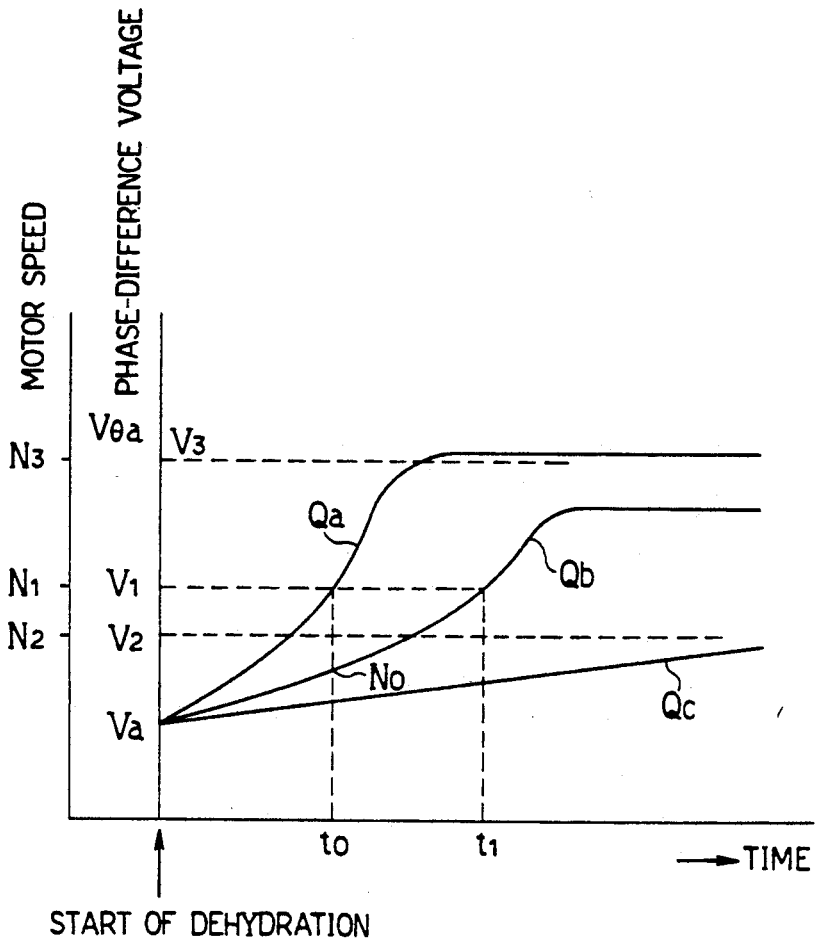
FIG. 4 is a graph showing characteristics of variation in the rotational speed of the washing machine motor.

FIG. 4 shows rotational speed rise characteristics of the rotational tub 14 in different conditions. The characteristic curve $Q_a$ shows the rotational speed rise characteristic in the condition that the rotational tub 14 is normally started and its rotational speed is increased to a rated speed without being rotated in the unbalanced state. The characteristic curve $Q_b$ shows the rotational speed rise characteristic in the case where the rotational tub 14 is in the state of relatively slight abnormal vibration, which vibration can be detected by the detecting lever 25. The characteristic curve $Q_c$ shows the rotational speed rise characteristic in the case where the rotational tub 14 is in the state of severe abnormal vibration.

The microcomputer serves as second abnormal vibration detecting means. More specifically, the microcomputer has a storage section storing data represented by the above-described characteristic curve $Q_b$ showing the rotational speed rise characteristic in the case where the rotational tub 14 is in the state of relatively slight abnormal vibration. Since this characteristic curve $Q_b$ is shown in the case where the rotational tub 14 is being vibrated slightly abnormally, the rotational speeds in a region above the characteristic curve $Q_b$ do not show an abnormal vibration while those in a region below it show an abnormal vibration.

The rotational speed at which the detecting lever 25 is operated is in the vicinity of $N_0$ (in the vicinity of time $t_0$). In the embodiment, the rotational speed $N_1$ on the characteristic curve $Q_b$, which rotational speed corresponds to the phase difference voltage $V_1$, is set as a reference rotational speed for the detection of the abnormal vibration by the second abnormal vibration detecting means. As described above, this reference rotational speed $N_1$ is between the rotational speed $N_2$ corresponding to the maximum torque point of the motor and the normal rotational speed $N_3$. The reference rotational speed $N_1$ appears on the characteristic curve $Q_b$ when a time period $t_1$ has elapsed from the start of the dehydrating operation. Accordingly, the microcomputer generates a signal representative of occurrence of the abnormal vibration when the reference rotational speed $N_1$ is not reached even after elapse of the time period $t_1$. The microcomputer performs various operations accompanied by the determination of occurrence of the abnormal vibration, for example, processing for modifying the unbalanced state of the rotational tub 14, when the abnormal vibration is detected by the first abnormal vibration detecting means or by the microcomputer as the second abnormal vibration detecting means.

The operation of the above-described abnormal vibration detecting device will now be described together with control contents of the microcomputer. FIG. 5 is a flowchart showing the control contents of the microcomputer. The control manner shown in FIG. 5 is initiated after completion of a wash or rinse step when an automatic operation course is set. When an independent dehydration course is set, the control manner is initiated based on the operation of the start switch.

The drain valve 19 is opened (step P1) and then, the washing machine motor 16 is energized so that the rotational tub 14 is rotated (step P2). Simultaneously, a timing operation is initiated for progress of the set time period (step P3). Then, it is determined whether the detection switch 24 has been operated or not (step P4). When it is determined that the detection switch 24 has not been operated, the rotational speed is detected based on the phase difference detection signal $V_{\theta a}$ supplied from the phase difference detection circuit 35 or the A/D converter (not shown) to the microcomputer (step P5). The microcomputer then determines whether or not the rotational speed is at the reference rotational speed value $N_1$ or below (step P6). When determining that the rotational speed is at the reference rotational speed value $N_1$ or below, the microcomputer determines whether the reference time period $t_1$ for determination has elapsed or not (step P7). The microcomputer then determines whether the set dehydration time period has elapsed or not (step P8). When the rotational speed exceeds the reference value $N_1$ before lapse of the reference time period $t_1$, the dehydrating operation is executed until the set dehydration time period elapses. Subsequently, the washing machine motor 16 is deenergized so that the rotation of the rotational tub 14 is stopped, whereby the dehydrating operation is completed (step P9).

In the case where the detection switch 24 is actuated (step P4) or where the rotational speed is at the reference value $N_1$ or below even when the reference time period $t_1$ has elapsed (step P7), the microcomputer determines that an abnormal vibration is occurring and executes steps P10 through P14 for correction of the unbalanced state of the dehydration tub. More specifically, first, the washing machine motor 16 is deenergized so that the rotational tub 14 is stopped (step P10) and the drain valve 19 is closed (step P11). Then, the water-supply valve 23 is opened so that the water is supplied to reach the set water level (step P12). The washing machine motor 16 is then energized so that the agitator 15 is driven for a predetermined period of time (step P13). The drive of the agitator 15 agitates the clothes such that an unbalanced distribution of the clothes in the rotational tub can be dissolved. Subsequently, the drain valve 19 is opened for the drainage (step P14) and then, the microcomputer advances to step P2.

It is considered that the transverse vibration component is larger than the longitudinal vibration component in the vibration mode of the rotational tub 14 and vice versa, depending upon the unbalanced distribution of the clothes in the rotational tub 14. When the transverse vibration component is larger than the longitudinal vibration component, such transverse vibration component is detected by the detection switch 24 via the detecting lever 25.

On the other hand, when the abnormal vibration is in such a mode that the longitudinal vibration component is relatively large and the transverse vibration component is too small to be detected by the detecting lever 25, the abnormal vibration in this mode is detected by the second abnormal vibration detecting means determining whether or not the rotational speed has exceeded the reference value $N_1$ upon lapse of the reference time period t1. Since the detection of this kind of abnormal vibration is based on the rotational speed of the washing machine motor 16, even the abnormal vibration mainly composed of the longitudinal component can be reliably detected, while this kind of abnormal vibration cannot be detected in the arrangement that the actual motion of the rotational tub is converted to a mechanical stroke. Consequently, the abnormal vibration can be reliably detected regardless of the directions of vibration and degree of vibration.

Although the invention is applied to the automatic washing machine in the foregoing embodiment, the invention may be applied to the dehydration control of twin-tub type washing machines.

The foregoing disclosure and drawings are merely illustrative of the principles of the present invention and are not to be interpreted in a limiting sense. The only limitation is to be determined from the scope of the appended claims.

We claim:

1. An abnormal vibration detecting device for a washing machine having an outer cabinet, a water-receiving tub mounted via elastic suspension means in the outer cabinet, a rotational tub mounted in the water-receiving tub for enclosing clothes to be washed and an electric motor driving the rotational tub in a dehydration operation, the abnormal vibration detecting device comprising:

a) rotational speed detecting means for detecting a rotational speed of the rotational tub, the rotational speed detecting means generating a detection signal representative of the detected rotational speed of the rotational tub;

b)storage means for storing data of predetermined rotational speed rise characteristics of the rotational tub as abnormal condition determining data, the predetermined rotational speed rise characteristics being in accordance with rise characteristics of the rotational speed of the rotational tub when the rotational tub is rotated in an unbalanced state and corresponding to rotational speed rise characteristics of the rotational tub in a range of the rotational speed of the motor at a maximum torque thereof or above; .

c) abnormal condition determining means comparing data of the rotational speed represented by the detection signal generated by the rotational speed detecting means with the abnormal condition determining data stored in the storage means, for determining whether or not the rotational tub is being rotated in the unbalanced state; and d) tub motion detecting switch means including a detecting lever disposed to be moved when colliding with a part of the water-receiving tub swinging due to vibration caused by the unbalanced state of the rotational tub and a detection switch responding to the motion of the detecting lever.

2. An abnormal vibration detecting device according to claim 1, wherein the abnormal condition determining data includes data of a set elapsed period from the time of energization of the motor for the purpose of starting and data of a set rotational speed at the time when the set elapsed period has elapsed.

3. An abnormal vibration detecting device according to claim 1, wherein the rotational speed detecting means comprises circuit means for detecting a phase difference between a voltage applied to the motor and a motor current and means for obtaining a signal representative of the rotational speed from a magnitude of the phase difference detected by the circuit means.

* * * * *